United States Patent [19]

Yoon

[11] Patent Number: 4,488,517

[45] Date of Patent: Dec. 18, 1984

[54] COLD START METHOD WITH START-UP GASEOUS FUEL GENERATION SYSTEM FOR METHANOL FUELED CARS

[75] Inventor: Heeyoung Yoon, McMurray, Pa.

[73] Assignee: Conoco Inc., Wilmington, Del.

[21] Appl. No.: 485,149

[22] Filed: Apr. 15, 1983

[51] Int. Cl.[3] ..... F02B 43/08; F02M 13/06

[52] U.S. Cl. ..... 123/3; 123/DIG. 12; 123/1 A; 123/179 G; 123/180 AC; 123/557; 123/576; 48/197 FM

[58] Field of Search ..... 123/1 A, 3, DIG. 12, 123/180 AC, 179 G, 557, 576, 525; 48/197 R, 197 FM

[56] References Cited

U.S. PATENT DOCUMENTS

| | | | |
|---|---|---|---|
| 3,886,919 | 6/1975 | Freeman | 123/557 |
| 3,931,800 | 1/1976 | Gendron | 123/557 |
| 3,989,019 | 11/1976 | Brandt et al. | 123/557 |
| 4,046,522 | 9/1977 | Chen et al. | 123/3 |
| 4,047,512 | 9/1977 | Hough et al. | 123/557 |
| 4,088,450 | 5/1978 | Kosaka et al. | 123/DIG. 12 |
| 4,143,620 | 3/1979 | Noguchi et al. | 123/3 |
| 4,170,200 | 10/1979 | Takeuchi et al. | 123/DIG. 12 |
| 4,210,103 | 7/1980 | Dimitroff et al. | 123/3 |

FOREIGN PATENT DOCUMENTS 45601 2/1982 European Pat. Off. ..... 123/180 AC

OTHER PUBLICATIONS

Kukuchi et al., Catalyst for On-Board Reforming of Methanol, J. Japan Petrol. Inst. 23, (5), 328-333 (1980).

Greiner et al., Engine Cold-Start with Dissociated Methanol, pp. 1-6, Tables 1-4, FIGS. 1-4.

*Primary Examiner*—Ethel R. Cross

*Attorney, Agent, or Firm*—Dale Lovercheck; William A. Mikesell, Jr.

[57] ABSTRACT

A method of cold starting an internal combustion engine operated on atomized liquid fuel after start up comprising the steps of:

heating a vaporization means with an electrical resistance heating element, heating a catalytic dissociation reactor with an electrical resistance element, pumping liquid alcohol to said heated vaporization means to form a vaporized alcohol, conveying air and vaporized alcohol to said catalytic dissociation reactor wherein partial combustion of said vaporized alcohol occurs as well as dissociation of said vaporized alcohol to form a partial start up fuel mixture comprising hydrogen and carbon monoxide, pumping liquid alcohol to an atomization means to form atomized liquid alcohol, adding said partial start up fuel mixture and said atomized liquid alcohol to form a complete start up fuel mixture, conveying said complete start up fuel mixture to said internal combustion engine, starting said internal combustion engine by igniting a mixture of air and complete start up fuel mixture therewithin.

1 Claim, 3 Drawing Figures

COLD START METHOD WITH START-UP GASEOUS FUEL GENERATION SYSTEM FOR METHANOL FUELED CARS

BACKGROUND OF THE INVENTION

Kikuchi discloses a catalyst system for on-board reforming of methanol using catalytic partial combustion and decomposition of methanol in J. Japan Petrol. Inst., (23, (5), 328–333 (1980)). For example, at start up with cold exhaust gases, methanol is converted by exothermic partial combustion that is then changed to decomposition by cutting off the air supply to the reformer when the catalyst bed is warmed up sufficiently and hot exhaust gases become available.

Greiner et al discloses an engine cold start with dissociated methanol system. Greiner uses thermal decomposition of methanol to products that include hydrogen in order to start an internal combustion engine.

Freeman U.S. Pat. No. 3,886,919 discloses a liquid fuel gasifier wherein liquid fuel is heated by contact with the exhaust gas in a heat exchanger.

Gendron U.S. Pat. No. 3,931,800 discloses a system to convert liquid fuel to gas for an internal combustion engine.

Hough et al U.S. Pat. No. 4,047,512 discloses an electrically powered liquid fuel vaporizer for an internal combustion engine.

Brandt et al U.S. Pat. No. 3,989,019 discloses a fuel heating apparatus for heating fuel for an internal combustion engine to raise the temperature thereof prior to the passage of fuel into the engine for combustion. The system uses an auxiliary heater which maintains the fuel and cooling medium heated in the chamber when the engine is not in operation to facilitate starting of a cold engine.

Noguchi et al U.S. Pat. No. 4,143,620 discloses a fuel reforming system for an internal combustion engine including a fuel reforming reactor vessel containing a catalyst for facilitating a catalytic reformation of the mixture into a reformed gas mixture rich with free hydrogen.

SUMMARY OF THE INVENTION

A start up reactor comprising a source of electrical current, a catalytic material and electrical resistance heating means, a fuel inlet, and air inlet and a product outlet, said electrical resistance means being electrically connected to said source of electrical current said fuel inlet means being connected to said catalyst containing body member, said air inlet means being connected to said catalyst containing body member said product outlet means being connected to said catalyst containing body member, said electrically resistance heating means being housed within said catalyst containing body member, said fuel inlet means being in fluid flow communicataion with a source of air.

A method of cold starting an internal combustion engine operated on atomized liquid fuel after start up comprising the steps of:

heating a vaporization means with an electrical resistance heating element, heating a catalytic dissociation reactor with an electrical resistance element, pumping liquid alcohol to said heated vaporization means to form a vaporized alcohol, conveying air and vaporized alcohol to said catalytic dissociation reactor wherein partial combustion of said vaporized alcohol occurs as well as dissociation of said vaporized alcohol to form a partial start up fuel mixture comprising hydrogen and carbon monoxide, pumping liquid alcohol to an atomization means to form atomized liquid alcohol, adding said partial start up fuel mixture and said atomized liquid alcohol to form a complete start up fuel mixture, conveying said complete start up fuel mixture to said internal combustion engine, starting said internal combustion engine by igniting a mixture of air and complete start up fuel mixture therewithin.

DETAILED DESCRIPTION OF THE INVENTION

Figure 1:
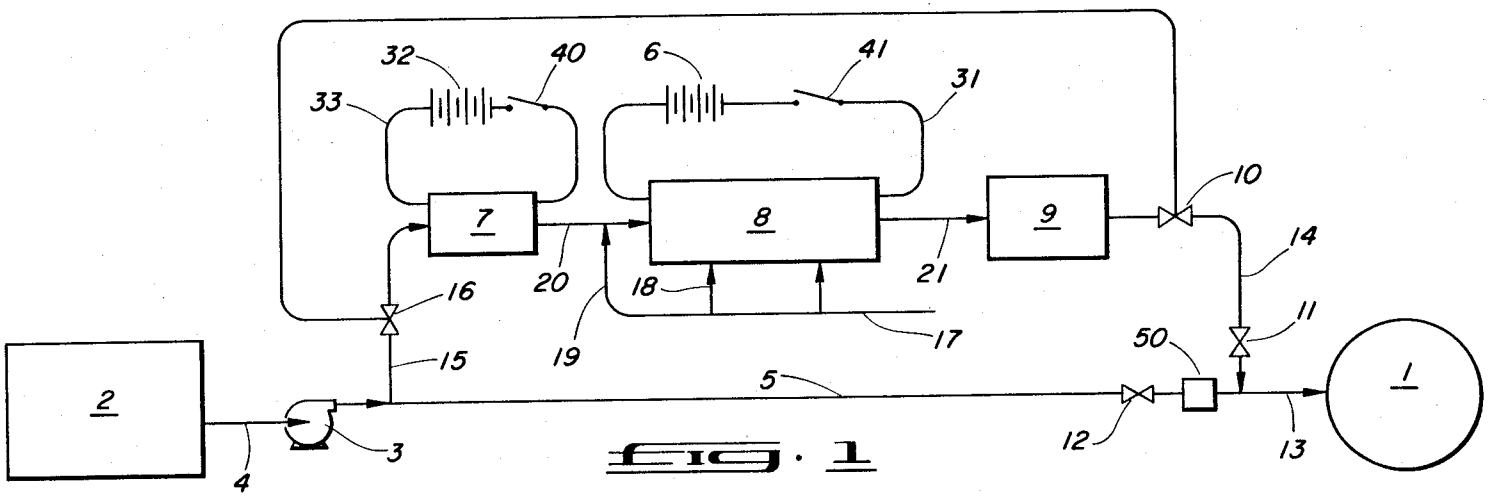
FIG. 1 shows a preferred embodiment of a start up system in accordance with the present invention.

With more particular reference to the drawing, FIG. 1 shows a preferred embodiment in accordance with the present invention.

The engine 1 operates on fuel from fuel tank 2 pumped through line 4 by pump 3 into main fuel line 5. Main fuel line 5 is connected to engine feed line 13.

During start up the valve 12 in line 5 is partially closed.

During start up valve 16 in line 15 and valves 10 and 11 in line 14 are open. The vaporizer 7 is electrically heated with electrical current from battery 32 fed to the vaporizer through switch 40 in line 33. Simultaneously the start up reactor 8 is heated with electrical current from battery 6 which flows through switch 41 in line 31 to the start up reactor 8. To start the engine fuel from fuel tank 2 is pumped by pump 3 both through line 4 and valve 12 in line 5 and atomized in a carburetor device 50 in line 12 and through line 15 into vaporizer 7 wherein the fuel is vaporized into a gas which passes through line 20 to start up reactor 8. Air is fed through line 17 to the reactor 8 through lines 18 and to the line 20 through line 19. The air from line 19 mixes with the vaporized fuel in line 20. The catalyst in reactor 8 is active for partial combustion as well as dissociation of methanol. Examples are Cu/Ni, Cu/Cr and Cu/Cr/Ni catalyst. Where the fuel is methanol, partial combustion with air takes place producing hydrogen rich gaseous fuel in the heated start up reactor. This partial combustion generates heat which produces more $H_2$ rich fuel by activating endothermic dissociation of methanol. Once the partial combustion is initiated in reactor 8, the electrical heating of the reactor is stopped by opening switch 41. The hydrogen rich gaseous fuel which leaves reactor 8 flows through line 21 to gas fuel storage container 9. The hydrogen rich gas flows from storage container 9 through line 14 and line 13 wherein it mixes with atomized liquid and flows to engine 1 for start up of the engine. After the engine is started the valves 16 and 10 are closed and the engine is operated on atomized liquid fuel fed through lines 4, 5 and 13. The atomization device 50 may be an automobile carburetor or fuel injection system as is known in the art.

Figure 2:
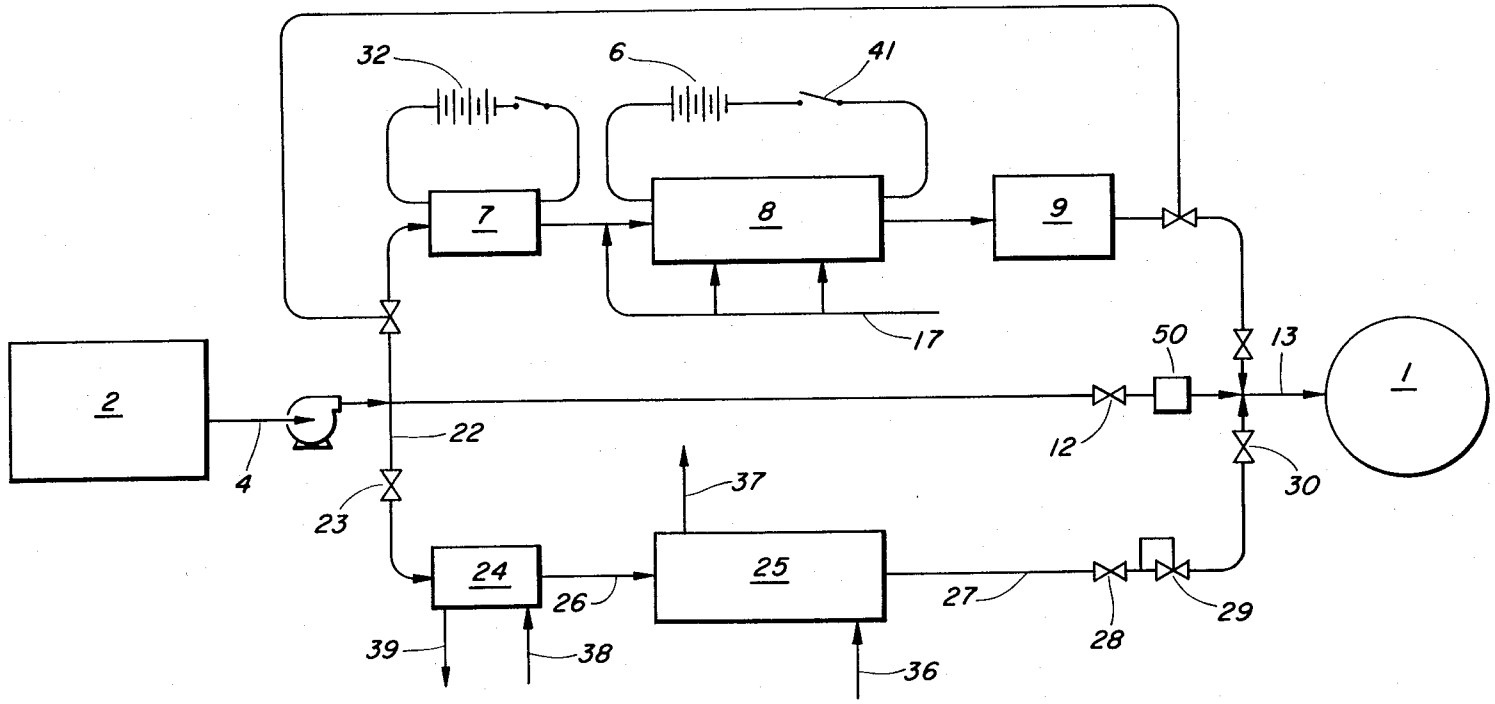
FIG. 2 shows an alternative start up system in accordance with the present invention.

FIG. 2 shows an alternative preferred embodiment in accordance with the present invention wherein the same number refers to the same item. In the embodiment of FIG. 2, the same start up system is used as that shown in FIG. 1. However, in the embodiment of FIG. 2 the engine 1 may be run on dissociated methanol. After start up as described herein above, fuel is fed from line 4 through line 22 to vaporizer 24 heated by engine coolant wherein the fuel is vaporized. Vaporized fuel from vaporizer 24 flows through line 26 to the main dissociator reactor 25. Main dissociator reactor 25 is heated by engine exhaust gas. The main dissociator reactor 25 contains a catalyst active for methanol dissociation, for example Cu/Zn catalyst. The hydrogen rich fuel formed by the dissociation of the vaporized fuel flows through line 27 and line 13 to the engine 1 wherein it is combusted.

To begin operation on dissociated methanol, the valves 23 and 28 are opened to allow liquid alcohol from fuel tank 2 to flow through line 4 and line 22. Line 27 is provided with pressure control valve 29 and valve 30. Engine coolant enters the vaporizer 24 through line 38 and leaves the vaporizer 24 through line 39. Engine exhaust gas enters the main dissociation reactor 25 through line 36 and leaves the reactor 25 through line 37

Figure 3:
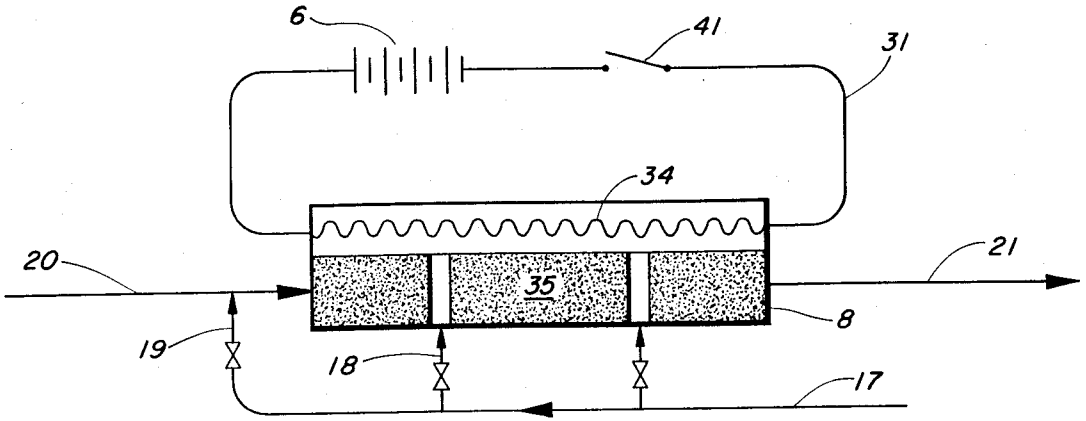
FIG. 3 shows a preferred embodiment of a start up reactor in accordance with the present invention.

With more particular reference to FIG. 3, a more detailed schematic representation of a start up reactor for use in accordance with the present invention is shown. The same number in FIG. 3 represents the same item as described in FIGS. 1 and 2.

The catalyst bed 35 is shown within the start up reactor 8. The electrical resistance heating element 34 is provided in association with the catalyst bed 35 to provide efficient heat transfer thereto.

EXAMPLE

The cold start method for a liquid methanol car requires the following sequential steps. (a) The catalyst bed is electrically preheated with the car battery to an effective temperature for the light-up of the partial combustion reactions. (b) Once the catalyst bed reaches the desired temperature, methanol to be fed to the reactor is vaporized and superheated by the battery power. (c) The superheated methanol is fed to the reactor along with air. (d) Additional air is injected at injection points along the catalyst bed. (e) In the reactor the methanol is decomposed to a hydrogen rich gaseous fuel. (f) The gaseous fuel and liquid methanol supplied through the main fuel line are fed to the engine for cold start. (g) Once the engine is warmed up, the engine is run only on substantially pure atomized liquid methanol by blocking the start-up reactor. The blocking automatically stores the gaseous product fuel in the pot.

For a dissociated methanol car, the following additional steps are required subsequent to the above described steps (a) to (f). (h) The exhaust gas from the engine after the engine cold start is fed to the main dissociation reactor to preheat the catalyst bed in the in the main reactor. (i) As soon as the main catalyst bed reaches desired operating temperature for methanol decomposition, superheated methanol is fed to the main reactor alone or with air. The methanol vaporization and superheating is achieved with the waste heat stored in the coolant and exhaust gas. (j) The start-up fuel generation system, which includes the start-up reactor, is shut down by isolating from the main fuel system.

Having thus described the invention by reference to certain of its preferred embodiments it is respectfully pointed out that embodiments described are illustrative rather than limiting in nature and that many variations and modifications are possible within the scope of the present invention. Such variations and modifications may appear obvious and desirable to those skilled in the art upon a review of the foregoing description of preferred embodiments.

What is claimed is:

1. A method of cold starting an internal combustion engine operated on atomized liquid fuel after start up comprising the steps of:

heating a vaporization means with an electrical resistance heating element, heating a catalytic dissociation reactor with an electrical resistance element, pumping liquid alcohol to said heated vaporization means to form a vaporized alcohol, conveying air and vaporized alcohol to said catalytic dissociation reactor wherein partial combustion of said vaporized alcohol occurs as well as dissociation of said vaporized alcohol to form a partial start up fuel mixture comprising hydrogen and carbon monoxide, pumping liquid alcohol to an atomization means to form atomized liquid alcohol, adding said partial start up fuel mixture and said atomized liquid alcohol to form a complete start up fuel mixture, conveying said complete start up fuel mixture to said internal combustion engine, starting said internal combustion engine by igniting a mixture of air and complete start up fuel mixture therewithin.

* * * * *